US006552491B1

(12) United States Patent
Bruning et al.

(10) Patent No.: US 6,552,491 B1
(45) Date of Patent: Apr. 22, 2003

(54) FLUORESCENT LAMP WITH INTEGRAL CIRCUITRY

(75) Inventors: Gert W. Bruning, Sleepy Hollow, NY (US); Jose Azevedo, Mahopac, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 107 days.

(21) Appl. No.: 09/736,013

(22) Filed: Dec. 13, 2000

(51) Int. Cl.[7] ..... H05B 41/00
(52) U.S. Cl. ..... 315/56; 315/72
(58) Field of Search ..... 315/56, 57, 58, 315/59, 71

(56) References Cited

U.S. PATENT DOCUMENTS

| | | | | |
|---|---|---|---|---|
| 2,733,371 A | | 1/1956 | Campbell | 313/185 |
| 4,082,981 A | | 4/1978 | Morton et al. | 315/97 |
| 4,163,176 A | | 7/1979 | Cohen et al. | 315/53 |
| 4,233,653 A | | 11/1980 | Jongerius et al. | 362/84 |
| 4,691,146 A | * | 9/1987 | Roux | 315/287 |
| 4,869,744 A | | 9/1989 | Romberg | 65/105 |
| 4,926,092 A | | 5/1990 | Gibson, III et al. | 313/493 |
| 5,004,949 A | | 4/1991 | Latassa et al. | 313/492 |
| 5,117,156 A | | 5/1992 | Leyh et al. | 315/73 |
| 5,485,057 A | | 1/1996 | Smallwood et al. | 315/58 |
| 5,654,609 A | | 8/1997 | Smallwood et al. | 315/56 |

FOREIGN PATENT DOCUMENTS

| | | |
|---|---|---|
| DE | 19512307 | 10/1996 |
| WO | WO9631996 | 10/1996 |

* cited by examiner

*Primary Examiner*—David Vu

(57) ABSTRACT

A tubular fluorescent lamp has a light emissive portion and an integral adjacent portion for containing power circuitry, such as an electronic ballast for providing high voltage power to electrodes of the lamp. All necessary electrical connections between the power circuitry and the electrodes are provided either within or on the lamp structure itself.

22 Claims, 4 Drawing Sheets

FLUORESCENT LAMP WITH INTEGRAL CIRCUITRY

BACKGROUND OF THE INVENTION

1. Field of the Invention

This invention relates to fluorescent lamps and, in particular, to the attachment of power circuitry to such lamps.

2. Description of Related Art

It is well known in the art to electrically connect fluorescent lamps to primary power sources via a variety of different types of power circuitry. For example, complex ballast circuits are commonly provided to perform a number of power-related functions including, inter alia, the conversion of power from the primary sources to AC voltages and frequencies corresponding to the requirements of respective lamps and the limiting and control of the flow of electrical current to the lamps. In recent years, electronic ballasts have been invented which are substantially smaller than their magnetic ballast precursors while even having the capabilities of performing additional functions, e.g. dimming. If the operating frequency is increased, the size of magnetic and filter components of an electronic ballast can be further decreased. As a consequence of increasing the frequency, however, voltage and current losses tend to increase, particularly because of losses in the impedances of long leads typically used to connect ballasts to lamps. More specifically, the leads have inductive impedances with voltage drops that increase with frequency and parasitic capacitances which bypass current intended for the lamp.

Traditionally, power circuits for fluorescent lamps are incorporated in fixtures for the lamps. This is done primarily because of size, weight, cost and safety factors of such circuits and, especially, in relationship to complex and relatively-heavy ballast circuits. However, if the power circuits can be operationally and cost effectively incorporated in the lamps, rather than in the fixtures, there are many advantages. To name a few:

- Each fixture will no longer be limited to use with specific lamp types which are associated with a specific power circuitry installed in the fixture.
- It will be impossible for the user to install the wrong lamp in the fixture.
- The power circuit and lamp can be optimized to work together to maximize efficiency and lamp life, while minimizing circuit volume and parts count.
- Fixtures can be less expensive, more attractive, and have more efficient reflector designs, because they will no longer need to be designed around the power circuitry.
- The need for long connection leads will be eliminated, thereby enabling an increase in operating frequency without the consequent increases in voltage and current losses.
- High-voltage power circuitry can be contained within the lamp envelope, thereby reducing shock hazards.

While the prior art describes miniaturized power circuitry for fitting within the envelope of a lamp, further development is needed to achieve effective containment of the circuitry within the envelope without adversely affecting operation of the lamp. For example, U.S. Pat. No. 5,485,057 suggests that a circuit module be encapsulated in a heat-transferring material so as to completely fill the end of a lamp envelope. Presumably this is also a gas-impermeable material and it is somehow secured in place and sealed to the envelope to prevent gas leakage either into or out of the lamp. However, no guidance is given as to what material should be used or how it will be secured in place without leakage or separation from the interior lamp envelope wall over the wide range of temperatures that will be experienced in operation. Further development is also needed to facilitate electrical connections to the circuitry. It becomes difficult to make such connections, when the circuitry is contained within the lamp envelope.

SUMMARY OF THE INVENTION

It is an object of the invention to provide a fluorescent lamp which is adapted for incorporating circuitry for powering the lamp.

It is another object of the invention to provide such a lamp in which the power circuitry is incorporated without detrimentally affecting operation of the lamp.

In accordance with the invention, a fluorescent lamp comprises a tubular envelope having a sealed light-emissive portion and an integral adjacent portion for containing power circuitry. The light-emissive portion contains longitudinally-separated first and second electrodes and an ionizable gaseous medium. The adjacent portion is physically isolated from the light-emissive portion by a gas-impervious sealed end of the light-emissive portion.

In one preferred form of the invention, the sealed end comprises a stem including leadthrough means, in communication with the sealed light-emissive portion and the integral adjacent portion, for electrically connecting the power circuitry to one of the electrodes.

DESCRIPTION OF THE PREFERRED EMBODIMENTS

Figure 1:
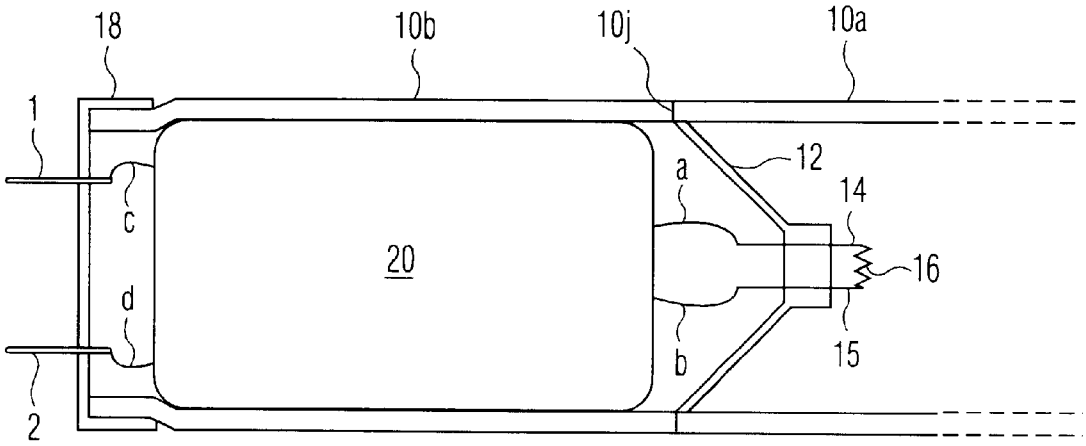
FIG. 1 is a partial view, partly in section, of a fluorescent lamp in accordance with an embodiment of the invention.

FIG. 1 illustrates a first embodiment of a fluorescent lamp in accordance with the invention. Specifically, FIG. 1 shows one end of a lamp which includes a glass tubular envelope having a sealed light-emissive portion 10*a* and a power-circuit portion 10*b*. The light-emissive portion, of which only a small portion is shown, contains an ionizable gaseous medium and has a fluorescent coating on an inner surface of the envelope.

The end of the light-emissive portion shown in FIG. 1 is sealed by a first stem 12 through which conductive feedthroughs 14 and 15 pass. The feedthroughs provide electrical connections and mechanical support for a first electrode 16. Such stems and their sealing to lamp envelopes are described in, for example, U.S. Pat. Nos. 5,117,156, 4,869,744, 5,004,949 and 4,926,092, which are hereby incorporated by reference. The opposite end (not shown) of the light-emissive portion is advantageously sealed by a second stem, similar to stem 12, for supporting a second electrode. As is well known in the art, the fluorescent material emits light radiation in response to the ionization of the gaseous molecules by an electrical discharge between the first and second electrodes.

The power-circuit portion 10*b* is an integral part of the tubular lamp envelope. In the embodiment shown, this portion is attached to the light-emissive portion 10*a* at a junction 10*j* by heating and fusing the two portions together. In an alternative embodiment (not shown) portions 10*a* and 10*b* are integral parts of a single tubular envelope. The demarcation between the two portions is defined by recessing the stem 12 within one end of the single envelope and sealing the rim of the stem to the inner surface of the envelope.

An opposite end of the tubular envelope portion 10*b* is constricted to form a collar for receiving an end cap 18. This can be done by a method such as is taught in U.S. Pat. No. 4,869,744. In one preferred embodiment, the end cap is molded from an electrically insulating material (such as a phenolic or other plastic material) and has conductive through pins 1 and 2 which are arranged for mating with a socket of a fluorescent lamp fixture. Alternatively, the end cap may be formed of a conductive material (such as aluminum) from which the through pins are electrically insulated by means of surrounding rings of glass or ceramic or other insulating material, as is known in the art. The pins may have a variety of cross-sectional shapes and positions, to correspond with the mating lamp sockets in the respective fixtures with which the lamps are intended to be used.

A circuit module 20 is disposed within the portion 10*b* and, in this exemplary embodiment, is electrically connected to the leadthroughs 14, 15 and pins 1,2 by conductors a,b and c,d, respectively. Preferably, the circuit module includes one or more circuit boards which may be potted within a heat-transmissive, electrically-insulating material (e.g. a sand-filled polyester or asphalt material) which is in good thermally-conductive contact with the glass of the tubular envelope portion 10*b*. Note that, by enclosing the circuit module 20 within the envelope 10*b* itself, certain power efficiencies are possible which may reduce the need for heat-dissipating measures such as potting. For example, by enclosing all high-voltage circuitry within the portion 10*b*, circuitry for protection against shock hazards can be eliminated.

Figure 2A:
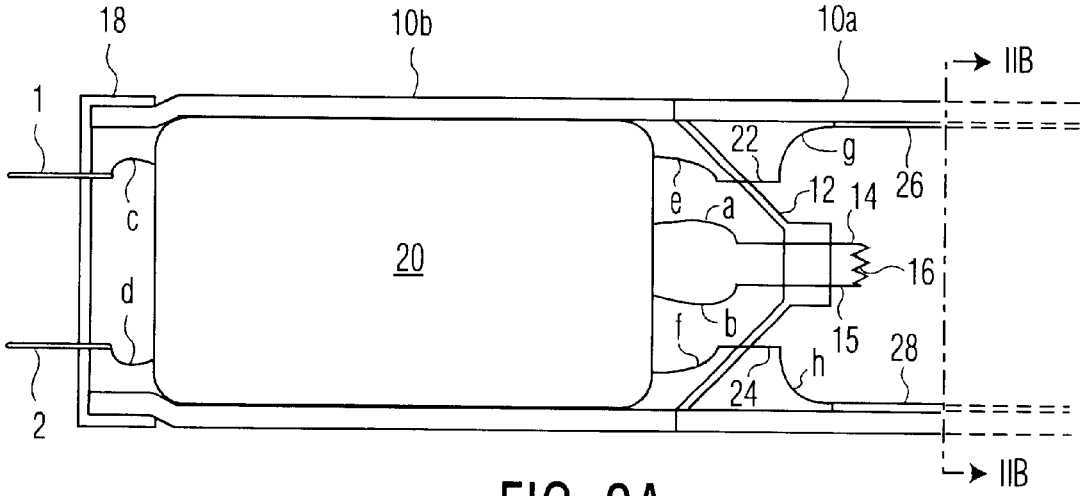
FIG. 2A is a partial view, partly in section, of a fluorescent lamp in accordance with an embodiment of the invention.
Figure 2B:
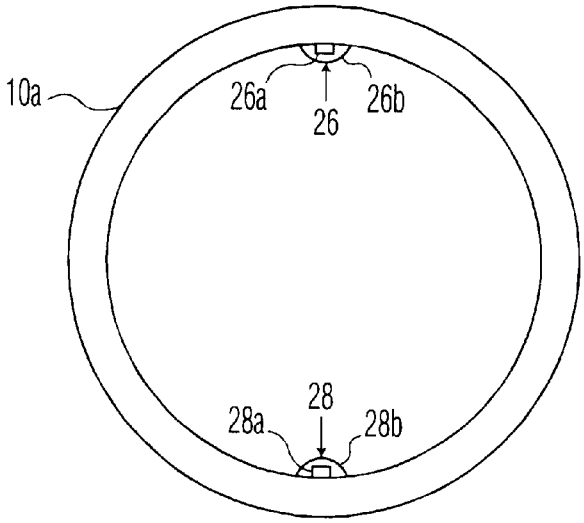
FIG. 2B is a cross-sectional view, taken along the line IIB—IIB in FIG. 2A.

FIGS. 2A and 2B illustrate a second embodiment of a fluorescent lamp in accordance with the invention. This embodiment is similar to that of FIG. 1, but further includes feedthroughs 22 and 24, which pass through the stem 12, insulated conductors 26 and 28, and insulated conductors e,f,g,h. Conductors e and f electrically connect the circuit module 20 to the feedthroughs 22 and 24, respectively. Conductors g and h electrically connect these feedthroughs to the conductors 26 and 28, respectively. The conductors 26 and 28 (shown in cross section in FIG. 2B) comprise conductive tracks 26*a*, 28*a* which are disposed on respective inner surfaces of the glass envelope portion 10*a* and covered with depositions 26*b*, 28*b* of an insulating material, such as a polymer film. This embodiment provides means for electrically connecting the power circuitry in module 20 to both ends of the lamp. For example, the conductive tracks 26*a*, 28*a* can be wired directly to a lamp electrode (not shown) at the opposite end of the light-emissive portion 10*a*. Alternatively, the conductive tracks 26*a*, 28*a* can be wired (via leadthroughs passing through a stem at the opposite end) to such a lamp electrode, to circuitry contained within the opposite end, or to pins in an end cap at the opposite end.

Figure 3A:
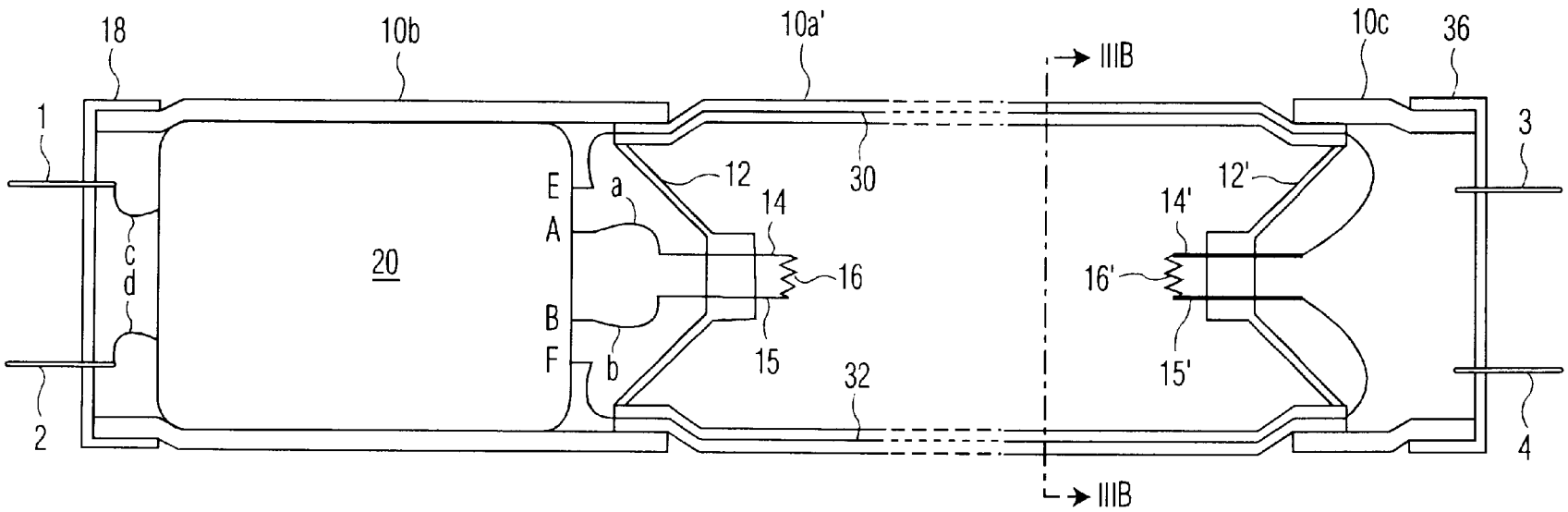
FIG. 3A is a broken view, partly in section, of a fluorescent lamp in accordance with an embodiment of the invention.
Figure 3B:
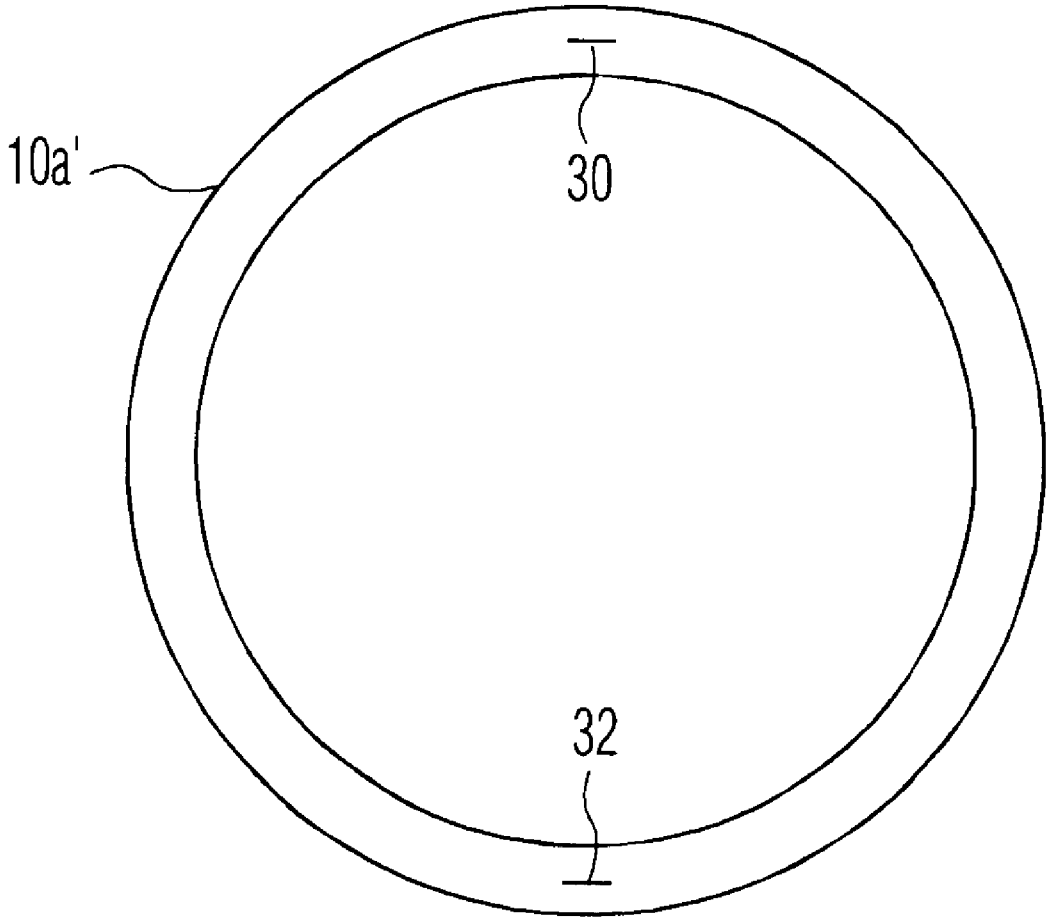
FIG. 3B is a cross-sectional view, taken along the line IIIB—IIIB in FIG. 3A.

FIGS. 3A and 3B illustrate a third embodiment of a fluorescent lamp in accordance with the invention. This embodiment is similar to that of FIGS. 2A and 2B, but includes conductors 30 and 32 which are embedded in the glass envelope of a light-emissive portion 10*a*'. Opposite ends of this light-emissive portion are constricted to form respective collars for receiving the power-circuit portion 10*b* and a glass tubular end portion 10*c*. These constricted ends of the light-emissive portion enable opposite ends of the conductors 30 and 32 to be led into spaces contained by the portions 10*b* and 10*c*. In this exemplary embodiment, the ends of the conductors 30, 32 that are within tubular portion 10*b* are connected to respective pins E and F of module 20, while the conductor ends within end portion 10*c* are connected to leadthroughs 14',15' in a stem 12' conductively supporting an electrode 16'. The end portion 10*c* has a constricted end for receiving an end cap 36, which is similar to the cap 18 and includes two through pins 3 and 4 that are arranged for mating with a socket of a fluorescent lamp fixture. In this embodiment, no electrical connections are made to these pins.

Figure 4A:
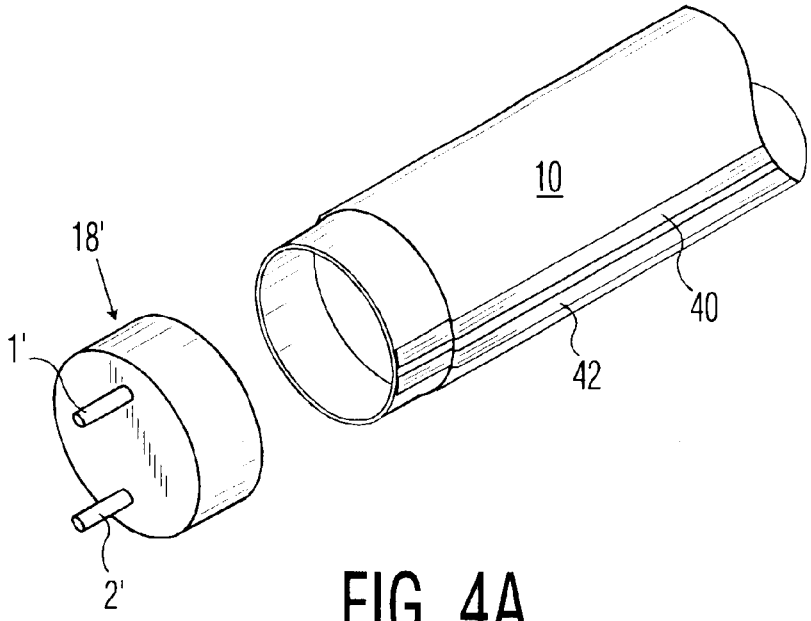
FIGS. 4A and 4B are exploded perspective views of one end of a fluorescent lamp in accordance with an embodiment of the invention.
Figure 4B:
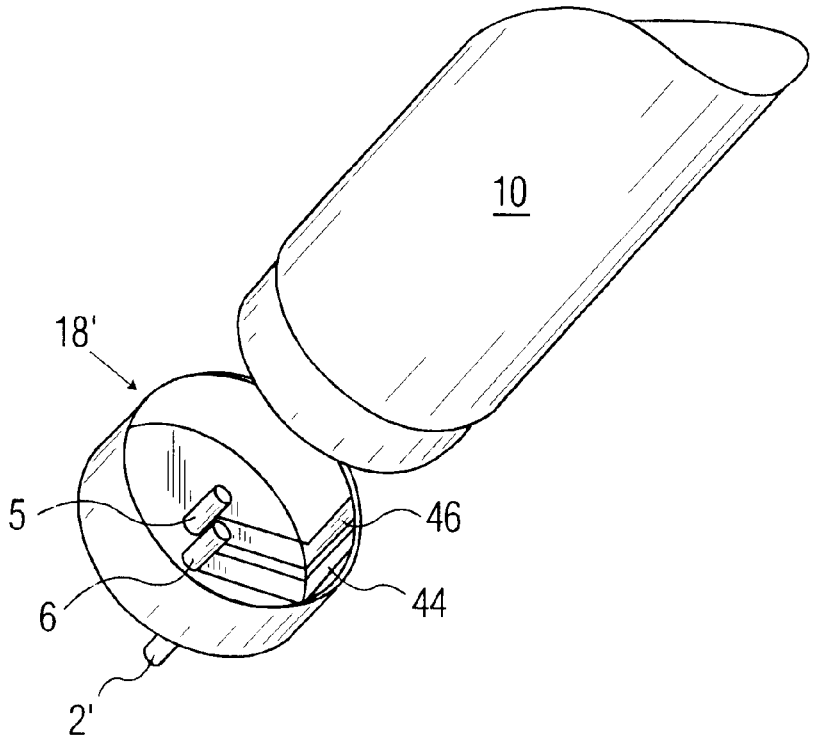

FIGS. 4A and 4B illustrate a fourth embodiment of a fluorescent lamp in accordance with the invention. Only one end of the lamp is shown in these figures. This embodiment is similar to those of FIGS. 2A and 3A, but includes conductors 40 and 42 which are disposed on an outer surface of the envelope 10 and run from a collar at one end (shown) to a collar at the other end (not shown). These conductors 40 and 42 are covered with electrical insulation (not shown) to protect against shorting and shock hazards. In one embodiment, the conductors are formed on the glass envelope 10 and coated with an insulating layer by using deposition techniques. In an alternative embodiment, the conductors comprise conductive strips which have an adhesive on one side, for attaching to the envelope, and an insulating covering on the opposite side. One such composite conductor, having a copper conductive strip formed on a mylar backing is available from 3M Corporation under the number/name 1181 Electrical Tape.

An end cap 18' is provided at each end of the envelope for sliding over the respective collar. Each of these end caps includes conductors 44 and 46 for making electrical contact (e.g. by a press fit) with the conductors 40 and 42, respectively, when the end cap is attached to the collar. The conductors 44 and 46 are formed as conductive tracks on the inner surface of the end cap and run from an edge of the end cap and up onto respective conductive pins 6 and 5, which are formed on an inner surface of the end cap and are oriented so that they extend into the envelope 10. To simplify manufacturing, the end cap 18' and the pins 6 and 5 preferably are molded as an integral unit from a plastic material. Conductive coatings are then applied to these pins and to respective inner surfaces of the end cap form the tracks 44 and 46. Preferably pins 1' and 2' also are integrally molded as part of the end cap. Note that these pins do not extend through the wall of the end cap, but project outwardly and away from the lamp. Whether or not this pins are conductively coated depends on their usage.

One exemplary use for this type of end cap is for making electrical connections to the electrode 16' shown in the embodiment of FIG. 3A. In that use, the pins 5 and 6 would be wired to the leadthroughs 14' and 15' by respective conductors and the pins 1' and 2' would be used only for mounting the lamp in a fixture. Alternatively, the pins 1' and 2' could be replaced with the through pins 1 and 2 shown in FIG. 3A and the end cap could be attached to the end of the envelope containing the module 20. In that case, pins 1 and 2 would be wired to terminals c and d and pins 5 and 6 would be wired to terminals E and F. Both of these types of end caps can be used in combination with the conductors 40 and 42 to make all of the connections shown in FIG. 3A, with the conductors 40 and 42 completing conductive paths from the terminals A and B to the leadthroughs 14' and 15' at the opposite end of lamp.

What is claimed is:

1. A fluorescent lamp comprising a tubular envelope having a sealed light-emissive portion for containing longitudinally separated first and second electrodes and an ionizable gaseous medium and having an adjacent portion for containing power circuitry for electrical connection to at least one of the electrodes, said adjacent portion being isolated from the light-emissive portion by a sealed end of said light-emissive portion.

2. A fluorescent lamp as in claim 1 where the sealed end comprises a stem including an electrical leadthrough for electrically connecting the power circuitry to one of the electrodes.

3. A fluorescent lamp as in claim 1 where the tubular envelope comprises joined first and second sections for forming the sealed light-emissive portion and the adjacent portion, respectively.

4. A fluorescent lamp as in claim 1 where the tubular envelope comprises an integral unit having a stem sealingly attached to an inner surface of said envelope for separating the sealed light-emissive portion and the adjacent portion, respectively.

5. A fluorescent lamp as in claim 1 where the light-emissive portion of the envelope supports a conductor extending along its length for electrical connection to the power circuitry.

6. A fluorescent lamp as in claim 5 where the conductor extends along an inner surface of the envelope and is covered with an electrically-insulating layer.

7. A fluorescent lamp as in claim 6 where the sealed end includes an electrical leadthrough for electrically connecting the conductor to the power circuitry.

8. A fluorescent lamp as in claim 5 where the conductor extends along an outer surface of the envelope and is covered with an electrically-insulating layer.

9. A fluorescent lamp as in claim 8 including an end cap for attachment to an end of the adjacent portion, said end cap supporting a conductive element for electrically connecting the conductor to the power circuitry.

10. A fluorescent lamp as in claim 9 where the conductive element comprises a conductive track disposed on an inner surface of the end cap.

11. A fluorescent lamp as in claim 8 including an end cap for attachment to an end of the tubular envelope, said end cap supporting a conductive element for electrically connecting the conductor to one of the first and second electrodes.

12. A fluorescent lamp as in claim 5 where the conductor is disposed within material forming the envelope itself.

13. A fluorescent lamp as in claim 12 where the conductor extends into the adjacent portion for electrical connection to the power circuitry.

14. A fluorescent lamp comprising:

a. a first tubular envelope portion for containing an ionizable gaseous medium and having first and second electrodes disposed within said medium adjacent respective sealed first and second ends of said envelope portion;

b. a second tubular envelope portion integrally attached to the first end for containing power circuitry for the lamp;

c. a conductor supported by the first tubular envelope portion for electrically connecting said power circuitry to the second electrode.

15. A fluorescent lamp as in claim 14 where the conductor comprises an insulated conductor extending along an inner surface of the first tubular envelope portion.

16. A fluorescent lamp as in claim 15 where the first end includes an electrical leadthrough for electrically connecting the conductor to the power circuitry.

17. A fluorescent lamp as in claim 14 where the conductor comprises an insulated conductor extending along an outer surface the first tubular envelope portion.

18. A fluorescent lamp as in claim 17 including an end cap for attachment to the first end, said end cap supporting a conductive element for electrically connecting the conductor to the power circuitry.

19. A fluorescent lamp as in claim 18 where the conductive element comprises a conductive track disposed on an inner surface of the end cap.

20. A fluorescent lamp as in claim 17 including an end cap for attachment to one of the first and second ends said end cap supporting a conductive element for electrically connecting the conductor to one of the first and second electrodes.

21. A fluorescent lamp as in claim 14 where the conductor is disposed within material forming the envelope itself.

22. A fluorescent lamp as in claim 21 where the conductor extends into the second tubular envelope portion for electrical connection to the power circuitry.

* * * * *